US005591036A

United States Patent [19]

Doi et al.

[11] Patent Number: 5,591,036

[45] Date of Patent: Jan. 7, 1997

[54] CIRCUIT BOARD CONNECTOR

[75] Inventors: Etsuro Doi, Saitama; Kiyoshi Atoh, Tokyo; Shoichi Mochizuki; Masakazu Koiso, both of Tama, all of Japan

[73] Assignee: Kel Corporation, Tokyo, Japan

[21] Appl. No.: 390,971

[22] Filed: Feb. 21, 1995

[30] Foreign Application Priority Data

Feb. 21, 1994 [JP] Japan ..... 6-46398

[51] Int. Cl.[6] ..... H01R 9/09

[52] U.S. Cl. ..... 439/79; 439/928.1

[58] Field of Search ..... 439/79, 80, 892.1, 439/381

[56] References Cited

U.S. PATENT DOCUMENTS

| | | | |
|---|---|---|---|
| 4,986,772 | 1/1991 | Fukutani | 439/892.1 OR |
| 5,078,626 | 1/1992 | Matsuoka et al. | 439/892.1 OR |
| 5,256,072 | 10/1993 | Hatagishi | 439/892.1 X |
| 5,259,773 | 11/1993 | Champion et al. | 439/79 X |
| 5,409,384 | 4/1995 | Green et al. | 439/79 X |

FOREIGN PATENT DOCUMENTS

| | | |
|---|---|---|
| 1-39433 | 11/1989 | Japan . |
| 1308095 | 12/1989 | Japan . |
| 4179078 | 6/1992 | Japan . |

*Primary Examiner*—P. Austin Bradley
*Assistant Examiner*—Daniel Wittels
*Attorney, Agent, or Firm*—Robert W. Usher

[57] ABSTRACT

An electrical connector of a right angle header type including a housing with a series of contact members having connecting portions and lead portions at mating and rear faces, respectively, the lead portions being bent through 90 degrees forming medial portions extending rearward from the rear face and board connecting portions extending downward so that free ends of the board connecting portions are insertable into respective connecting through-holes of a circuit board. A lead portion retaining member having lead portion locating groves on a lower face is releasably attached to the housing to extend over the medial portions to prevent upward movement thereof during insertion of the end portions into the respective connecting through-holes, thereby obviating risk of misjudgement that the connector is correctly installed on the circuit board. A lead locating and guiding member has a series of lead receiving apertures at positions corresponding to the connecting holes of the circuit board receiving respective connecting portions and is mounted on the housing for sliding movement from a first, lead locating position, receiving respective connecting portions at locations adjacent respective free ends thereof, to a second position, remote from the free ends, during movement of the board connecting portions progressively into respective connecting through-holes of the circuit board.

21 Claims, 8 Drawing Sheets

CIRCUIT BOARD CONNECTOR

FIELD OF INVENTION

This invention concerns a connector of a right angle-header type which is mounted on a circuit board by insertion of lead portions of contact members thereof into respective connecting through-holes of the circuit board.

BACKGROUND OF THE INVENTION

Connectors of the right-angle header type comprise an insulating housing with a front, mating face, a rear face and a lower, board engaging face extending between the front face and the rear face. A series of contact members are mounted in the housing with mating/connecting portions at the mating face and lead portions extending from the rear face, and which are bent downward, essentially through 90 degrees, intermediate their ends thereby forming medial portions extending rearward from the rear face essentially parallel to the circuit board and board connecting portions extending downward so that free ends of the board connecting portions are insertable into respective connecting through-holes of a circuit board. The mating connection with a complementary connector is made in a direction parallel to the upper surface of the printed circuit board (the horizontal direction). As the lead portion bending step generally takes place after assembly of the contact members with the housing, sufficient clearance must be left above the medial portions for access thereto by a suitable bending tool.

This type of connector frequently has a large number of individual contact members and must be inspected after assembly of the contact members with the housing to detect any lead deformations, such as folds or bends in the leads, so that the lead portions can be inserted smoothly into the through-holes when the connector is mounted on the circuit board.

Commonly, as described in Japan Public Patent Disclosure Bulletin No. 4-179078, Japan Public Utility Model Bulletin No. 1-39433, and Japan Public Patent Disclosure Bulletin No. 1-308095, a lead locating and guiding member is installed on such connectors.

The lead locating and guiding member has a series of lead receiving and guiding apertures at positions corresponding to the positions of the connecting holes of the circuit board and is mounted on the housing for sliding movement from a first, lead locating position, receiving respective free ends of the lead portions, to a second position, remote from the free ends, during movement of such free ends progressively into respective connecting through-holes.

During the installation of the connector on the circuit board, the lead locating and guiding member is first positioned on the printed board with the end portions of respective lead portions in registration with respective through-holes and the housing then pressed down onto the circuit board, lost motion between the lead locating and guiding member and the circuit board enabling the individual bep to slide through the guide holes guided individually guided thereby into the respective through-holes. In addition, the lead locating and guiding member securely holds the end portions prior to installation on the circuit board, preventing the lead portions from being greatly deformed by external forces applied to the medial portions of the leads. However, even if the leads have not been deformed during assembly of the connector, they are sometimes subjected to external deforming forces during subsequent transportation.

An attempt to install a connector with deformed lead portions which brings end portions of the deformed lead portions into abutment with the upper surface of the board instead of being inserted into the through-holes will cause the deformed lead portions to be pushed upward with respect to the housing thereby to accommodate the deformation with the result that the connector may appear to be located correctly on the upper surface of the board and therefore be judged, incorrectly, as correctly installed as though all of the lead portions were inserted into the through-holes.

This problem also arises in connectors with an lead locating and guiding member attached, as any deformed free end portions which project below the lead locating and guiding member may not be inserted into the through-holes when the connector is installed on the board.

SUMMARY OF THE INVENTION

An object of the invention is to provide a connector in which the risk of a misjudgement as to whether it has been installed correctly on a circuit board is obviated.

Another object of the invention is to provide a connector which will always be securely and correctly installed on a circuit board.

According to one aspect, the invention provides a lead portion retaining member which attaches to the insulating housingto extend adjacent and above the lead portions for preventing upward movement thereof during installation on a circuit board.

Preferably, the invention includes the lead portion locating member in combination with a lead locating and guiding member receiving the lead portions with tips of end portions thereof protuding below the lead locating and guiding member prior to installation of the connector on the circuit board.

More specifically, the invention provides an electrical connector of a right angle header type comprising a housing having a front, mating face, a rear face and a lower, board engaging face extending between the front face and the rear face, at least a part of the housing being insulating, a series of contact members mounted in the insulating part of the housing with connecting portions at the mating face and lead portions extending from the rear face, the lead portions being bent transversely intermediate their ends thereby forming medial portions extending rearward from the rear face and board connecting portions extending downward so that free ends of the board connecting portions are insertable into respective connecting through-holes of a circuit board by movement of the board engaging face of the housing into engagement with the circuit board; and a lead portion retaining member, means on the housing and the lead portion retaining member cooperable to attach the lead portion retaining member to the housing to extend over upper sides of the medial portions remote from their free ends thereby to prevent upward movement of respective medial portions away from the circuit board during insertion of the end portions into the respective connecting through-holes.

Even if an upward force is exerted on the lead portions, upward movement thereof with respect to the housing, is prevented by the lead portion retaining member, engaging the upper surfaces of the medial portions which will prevent installation of the connector on the circuit board if a lead end portion fouls the surface of the circuit board, enabling the discovery of the deformed lead portions.

BRIEF DESCRIPTION OF THE DRAWINGS

A specific embodiment of an electrical connector according to the invention will now be described by example only, with reference to the accompanying drawings in which.

DESCRIPTION OF PARTICULAR EMBODIMENT

Figure 1:
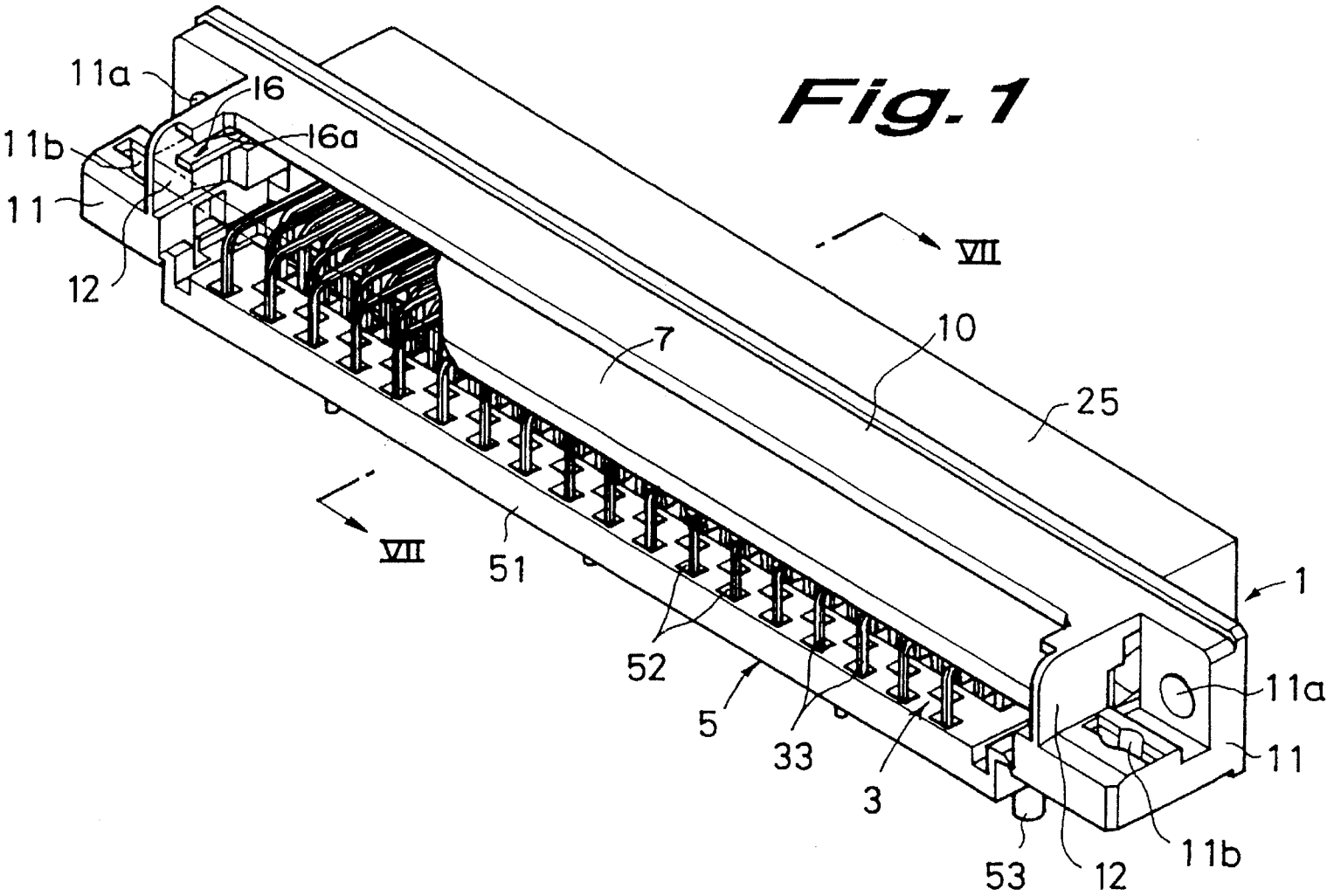
FIG. 1 is a perspective view, partly broken away, of the connector.
Figure 7:
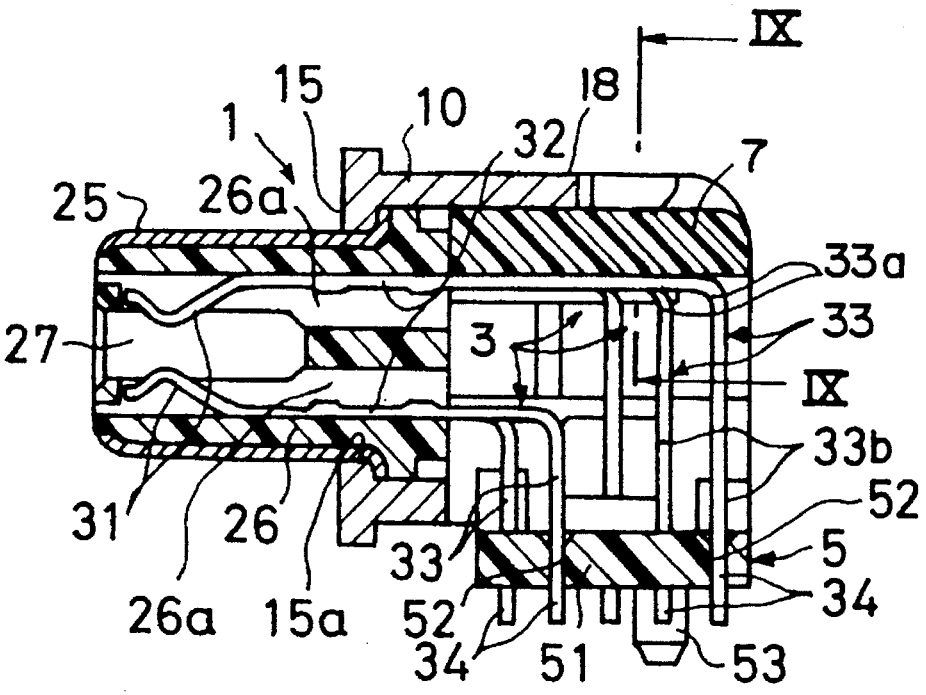
FIG. 7(*a*) and FIG. 7(*b*), respectively, are cross-sectional views of the connector taken along line 7—7 of FIG. 1, with the lead locating and guiding member in lower and upper position, respectively.
Figure 7:
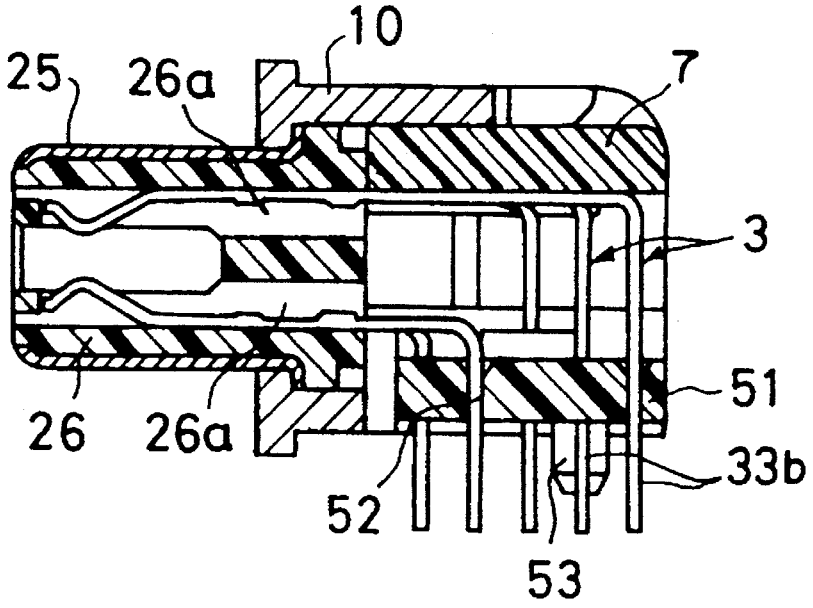

As shown particularly in FIG. 1 and FIG. 7, the connector comprises a housing 1, a series of contact members 3 which are mounted in rows in the housing 1, a lead locating and guiding member 5 which holds lead portions 33 of the contact members 3 in rows, and a lead portion locating member assembled with the housing 1.

Figure 2:
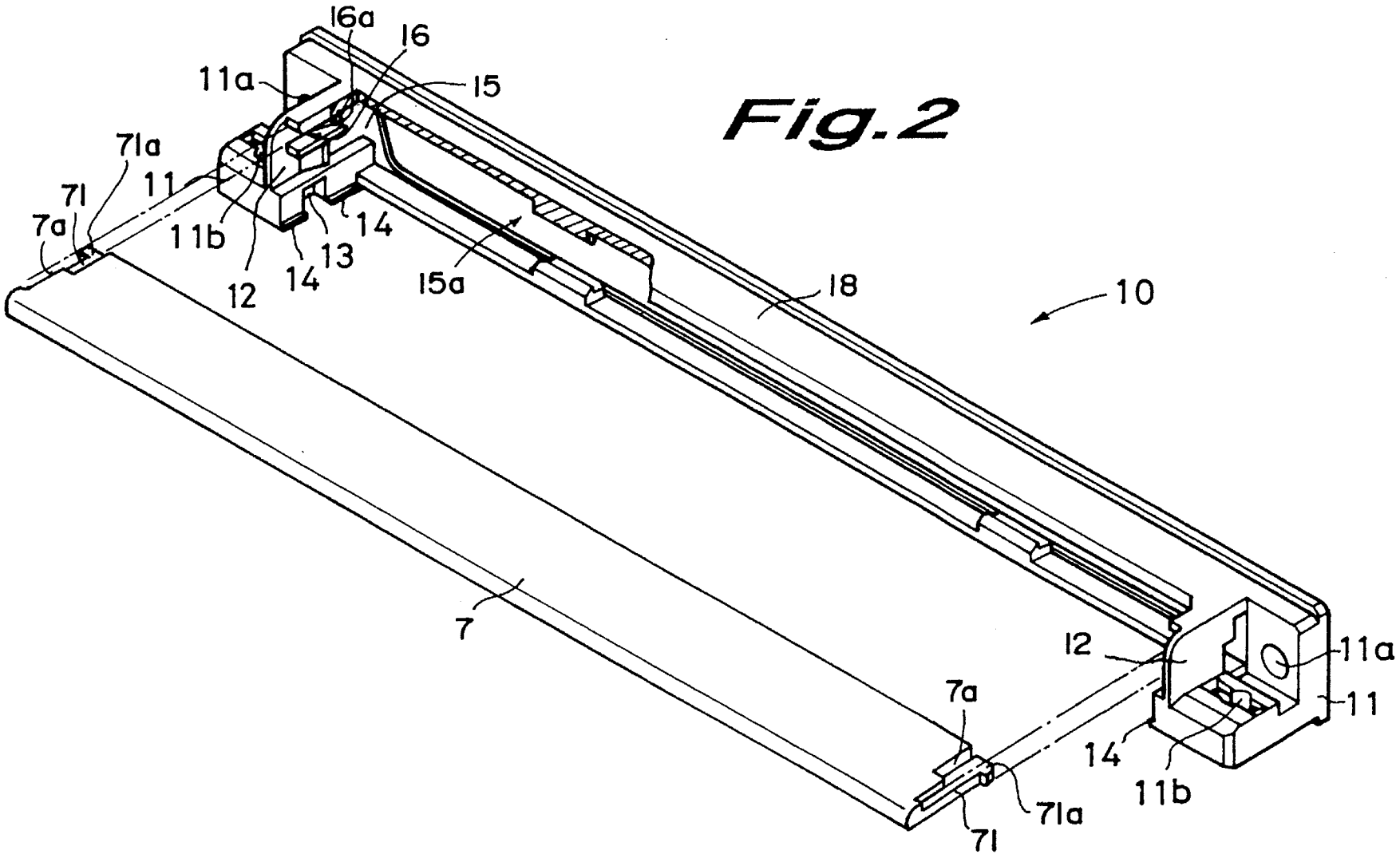
FIG. 2 is a perspective view, partly broken away, of a main housing part of the connector and a lead portion locating member exploded therefrom.

The housing 1 comprises a main die cast, metal housing body 10, shown more clearly in FIG. 2, an insulating, plastic, contact member receiving housing 26 which is inserted in a front assembly aperture 15*a* formed in a front, main body wall 15 of the main housing body 10 so as to protrude forward therefrom, and a metal shield casing 25 also inserted in the front assembly aperture 15 to protrude forward covering the periphery of the contact member receiving housing 26 in shielding relation therewith.

A plurality of rows of contact member receiving through bores 26*a* extend between the front and the rear of the contact member receiving housing 26 and receive the respective contact members as individual press fits. A mating cavity 27 for receiving a complementary connector is formed in the front, mating face of the contact member receiving housing 26 and mating connecting portions 31 of respective contact members are exposed therein for establishing electrical connection with corresponding contact members of the complementary connector.

The main housing body 10 is elongate having a front, vertical main body wall 15 formed with a central, elongate assembly aperture 15*a*, an upper wall part 18 extending rearward from an upper edge thereof, vertical wall parts 12 which extend rearward adjacent respective opposite (left and right) ends of the main body wall, and right angled attachment ears 11 on respective ends consisting of vertical, longitudinal extensions of respective ends of the main body wall 15 and rearward extending, horizontal mounting feet formed, respectively, with bolt insertion holes 11*a*, 11*b* for attachment with the mating connector and for attachment to the printed board, lower portions of inside surface portions of the vertical wall parts 12 are formed with inwardly opening guide grooves 13 which extend precisely vertically with entry ends open to a bottom, and inwardly protruding stops 14 which protrude inward on both sides of the guide grooves 13.

Figure 4:
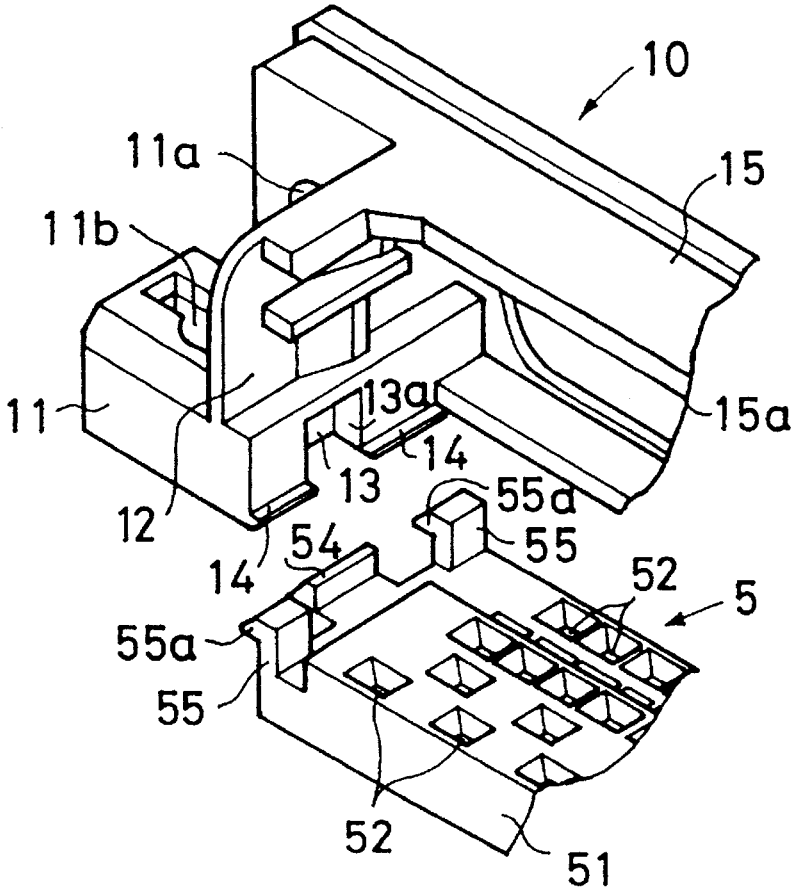
FIG. 4 is fragmentary perspective view showing details of cooperable attachment portions of the main housing part and one end of a lead locating and guiding member.
Figure 5:
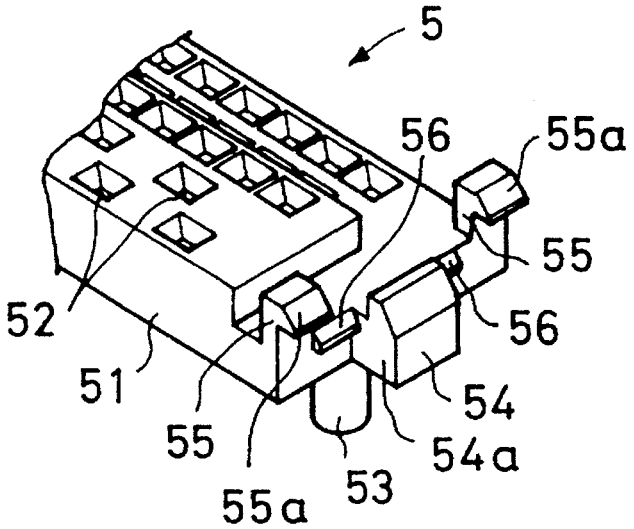
FIG. 5 is a fragmentary perspective view showing the other end of the lead locating and guiding member.
Figure 8:
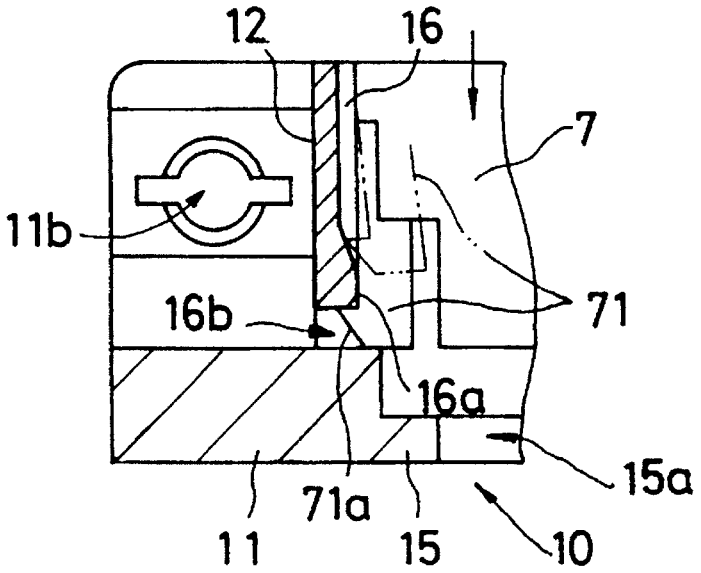
FIG. 8 is a plan view, partly in cross-section in a horizontal plane showing one end of the main housing part and the lead portion locating member.

As shown in FIGS. 2, 4 and 8, pairs of upper and lower guide rails 16 extend rearward from the front, main wall along inside surfaces of respective wall parts 12 at locations adjacent the top thereof, the upper guide rails being formed by reward extending portions of the upper wall part 18. Latching ramps 16*a* with inwardly and forwardly inclined beveled latching ramp surfaces are formed on the inside surfaces of the vertical wall parts 12 between the guide rails of each pair 16 and lead to latching apertures 16*b* which extend transversely through the vertical wall parts 12. As shown in FIG. 2, the upper wall part 18, extends rearward, approximately to centers of the guide rails.

Figure 9:
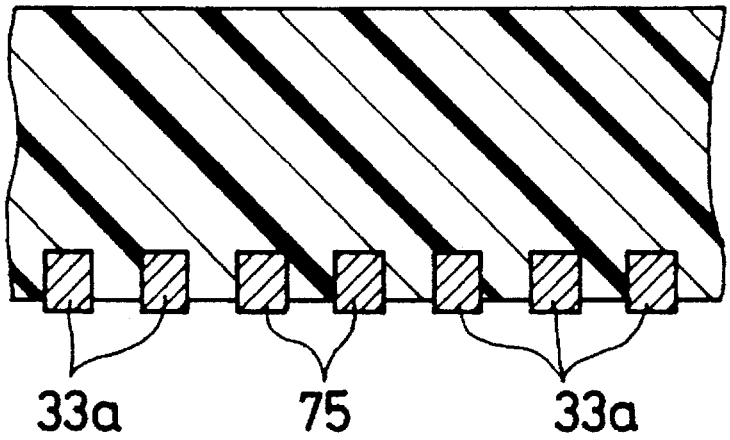
FIG. 9(*a*) and FIG. 9(*b*), respectively, are fragmentary cross-sectional and fragmentary underplan views, of the lead portion locating member; and, FIG. 10 is a cross-sectional view taken along a line similar to line 7—7 of FIG. 1 showing an attempt to install a connector with a lead portion having a bent free end on a circuit board.
Figure 9:
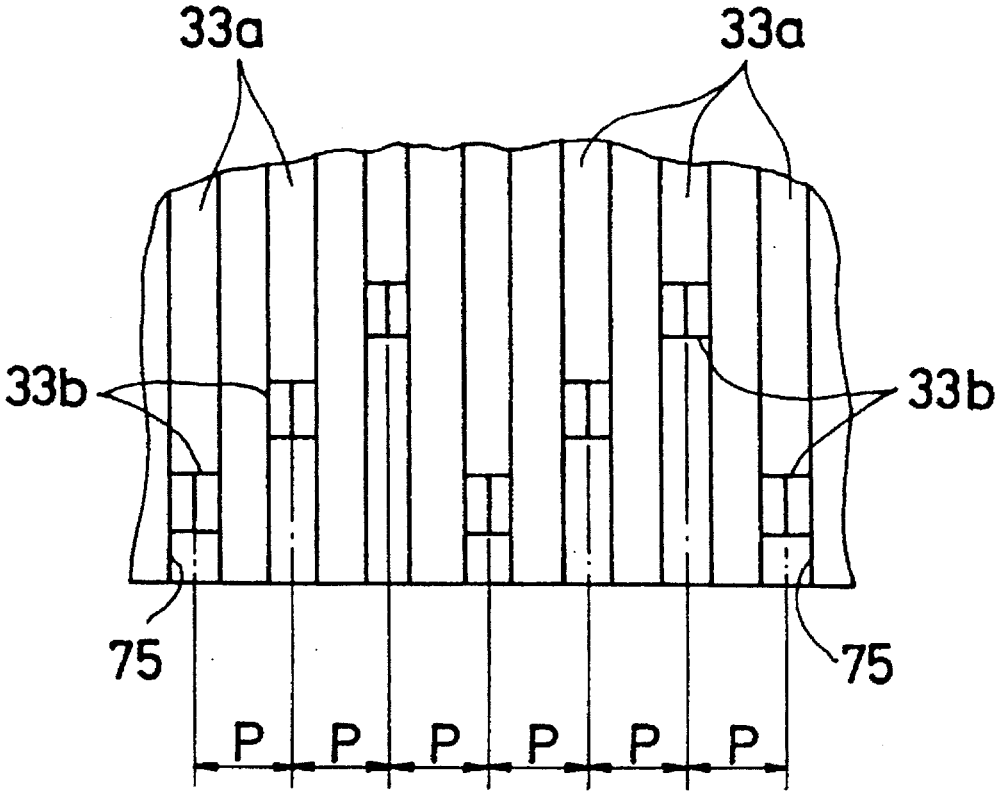

The lead portion retaining member 7 is formed as an elongate plate made from insulating material (resin, etc.) Step like cut-outs 7*a*, are formed in upper surface portions of respective opposite longitudinal ends so as to extend for half of the total thickness and latching arms 71 are formed in lower sides of the cut outs having forward free ends with outwardly directed, hook form latching heads 71*a* level with a front edge of the central part of the 1 prt. As shown in FIG. 9, a series of downward opening, lead portion aligning grooves 75 are formed on the undersurface of the lead portion retaining member 7 at the same pitch as the row pitch P of the uppermost row of lead portions 33.

The lead portion retaining member 7, is assembled with the main housing body 10 adjacent the upper wall part 18 by inserting the latching arms 71 forward, free ends leading, between the guide rails 16 from the rear until, as shown by the broken lines in FIG. 8, the latching heads 71*a* are initially resiliently flexed inward by engagement with the ramp surfaces eventually passing the front ends of the ramps 16*a* when they resile back to their undeformed positions where the hook form latching heads 71*a* enter the latching apertures with a snap action, latching the lead portion locating member therein, during insertion the lead portions are progressivley received as sliding fits along respective aligning grooves 75.

When thus installed, substantially the entire front half of the upper surface of the lead portion retaining member 7, is in engagement with the lower surface of the upper wall part 18, as shown in FIG. 7 (A), and the rear end is aligned with the rear ends of the vertical wall parts 12.

Figure 3:
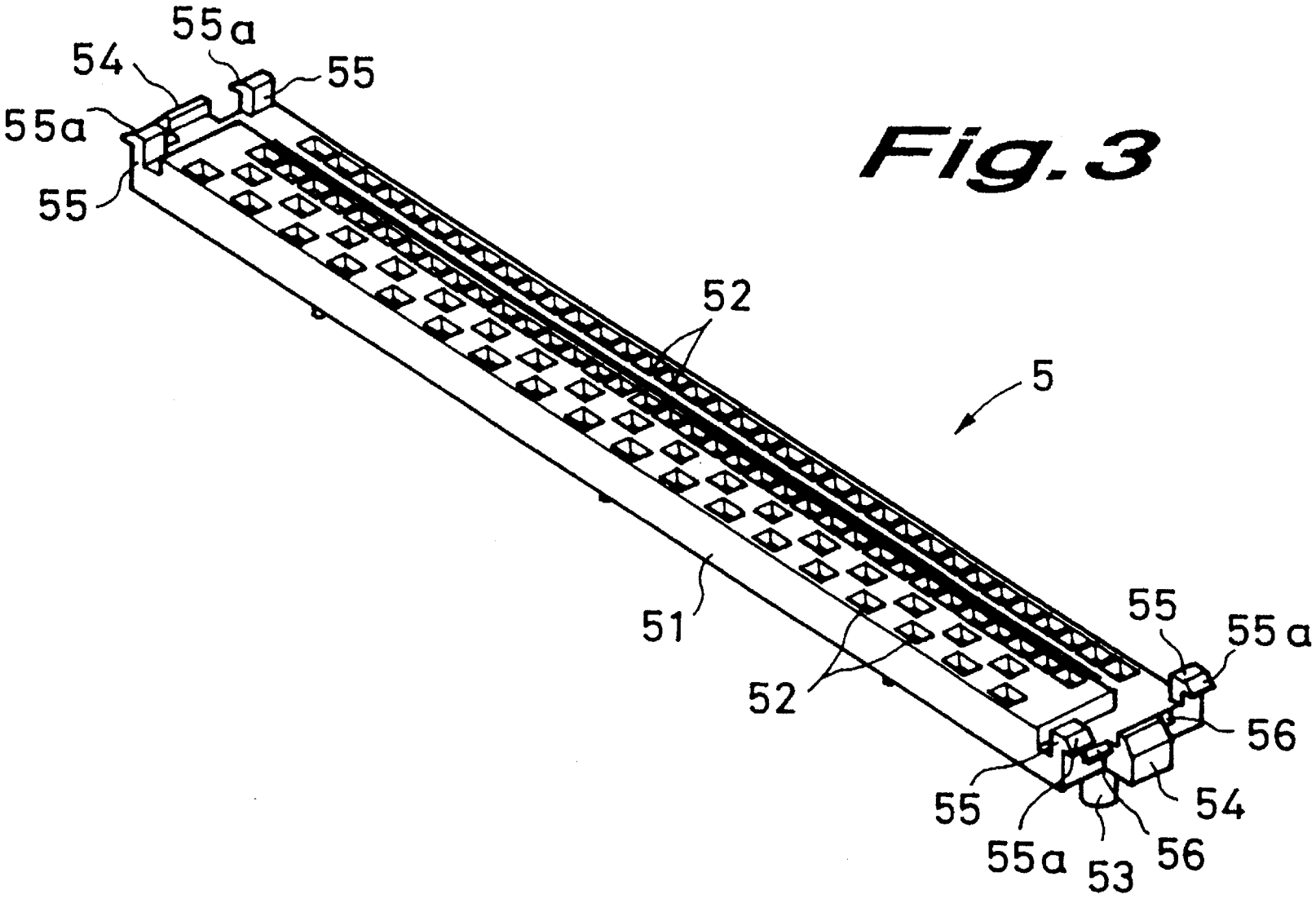
FIG. 3 is a perspective view of a lead locating and guiding member of the connector.

As shown in FIG. 3, a lead portion locating and guiding member 5 is integrally formed in one piece from insulating plastic and comprises a generally flat, bilevel, elongate, plate like main body part 51 perforated by rows of lead portion receiving guiding apertures 52. Positioning posts 53 for receipt in mounting apertures in a circuit board, depend from the lower surface at respective opposite ends so that the guiding apertures 52 are aligned vertically with respective through-holes of the circuit board.

Outwardly protruding guide projections having bevelled upper and outer leading edges 54 are formed on central locations of respective opposite ends and are dimensioned for sliding receipt in respective guide grooves 13 of the main housing body 10. A pair of upward extending, front and rear latching arms 55 having outwardly directed first latching projections 55*a* are formed on front and rear corners of the upper surface of respective opposite ends of member 5, and second pairs of outwardly directed latching projections 56 are formed at respective opposite ends, at locations in front of and behind respective guide projections 54 and between and below first latching projections 55.

The contact members 3 differ in precise individual dimensions according to their positions, but are all generally L-shape having the central, anchoring portions 32 retained in rows, one above the other, in the housing 1 by being received as a press fits in respective through bores 26*a*. The contact members 3 are each stamped and formed in one piece from sheet metal stock and each comprises a connnecting/mating portion which extends forward (leftward in FIG. 7) from the central portion 32, protruding into the mating cavity 27, as mentioned above, and a lead portion 33 which extends into a rear space of the housing 1 from the central portion 32. Each lead portion 33 is bent downward through 90 degrees approximately midway along its length forming a medial portion 33*a* which extends horizontally rearward from the central portion 32 and a board connecting portion 33*b* which extends downward therefrom, terminating in connecting end portions 34. As shown in FIG. 7(*a*), the upper surface of the medial portion 33*a* of the contact 33, held on the upper surface of the housing 1, touches the underside of the lead portion retaining member 7 when installed on the main housing body 10.

As shown in FIG. 9, opposed and top surfaces of the alignment grooves 75 slidingly engage side surfaces and upper surfaces, respectively, of the medial portions 33*a* thereby accurately positioning the medial portions laterally, in addition to preventing upward movement thereof, assisting in retaining the lead portions in respective rows.

End portions 34 are inserted in the guiding apertures 52 formed in the lead portion locating and guiding member 5 thereby retaining the lead portions 33 in rows.

Figure 6:
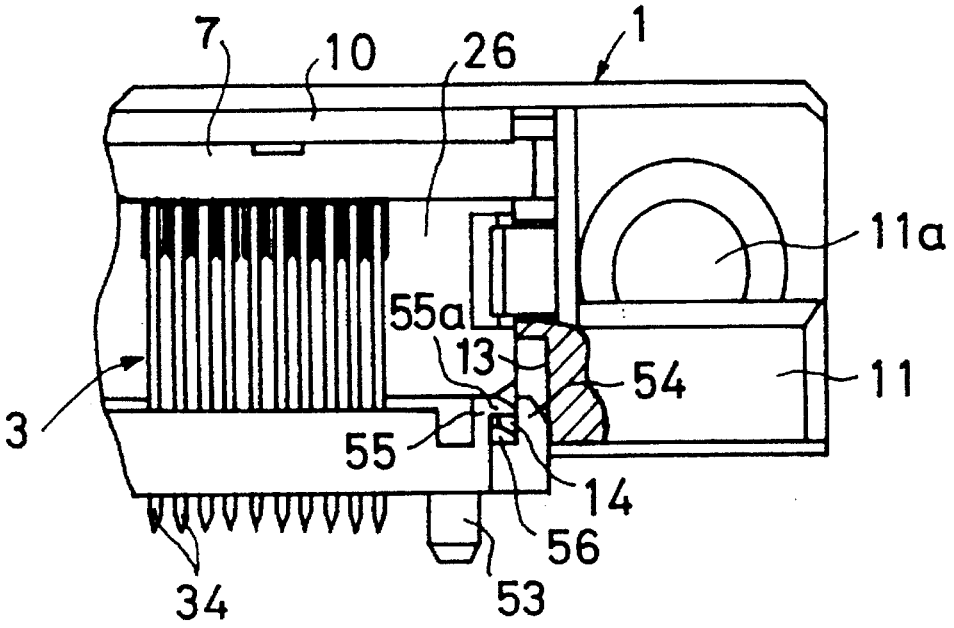
FIG. 6(*a*) and FIG. 6(*b*), respectively, are rear elevations of the connector partly broken away, with the lead locating and guiding member in lower and upper positions, respectively.
Figure 6:
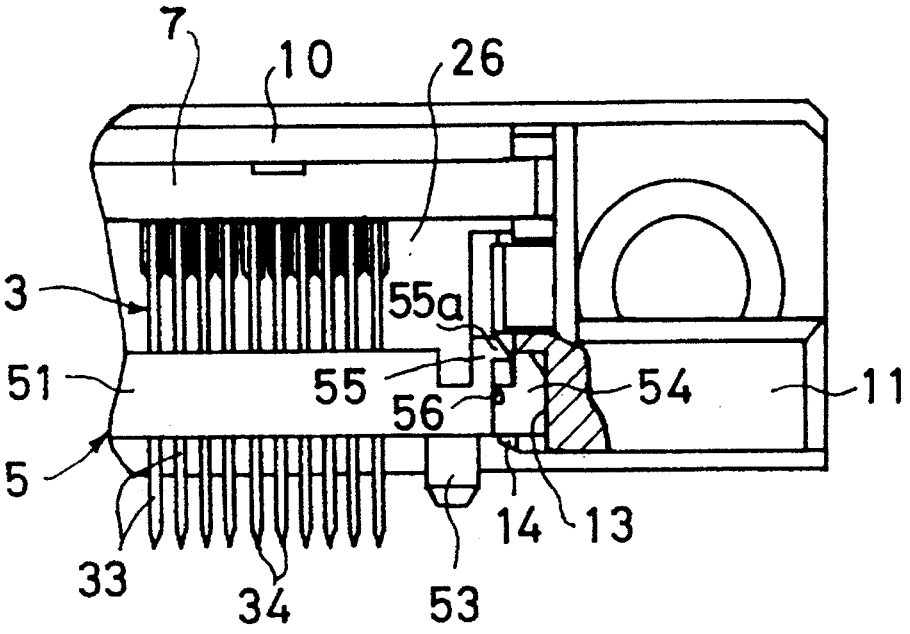

As shown in FIGS. 4, 5, 6 and 7, the lead portion locating and guiding member 5 is first installed on the main housing body 10 aligning respective guide projections 54 with lower entry ends of respective guide grooves and pressing the member 5 upward so that the first projections 55*a* engage, and flex resiliently inward, riding over the stop projections 14 so that the respective guide projections fully enter respective guide grooves 13 of the main housing body 10 and the second projections 56 are brought into engagement with lower surfaces of the stop projections 14 so that, as shown in FIG. 6 (A), the first and second projections 55*a* and 56 enclose the stop projections 14 from above and below thereby holding the lead portion locating and guiding member 5 stationary in this "lower position". As the side surfaces 54*a* of the guide projections 54 are in sliding engagement with the inner side surfaces 13*a* of the guide grooves and the first and second projections 55*a* and 56 and the stop projections 14 are located in pairs at both the front and rear, and on both ends, the main body portion 51 of the lead portion locating and guiding member 5 is maintained extending horizontally in all vertical positions in the guide groove even if an external tilting or twisting force is applied thereto.

Only upper surfaces of the first and second projections 55*a* and 56 are bevelled while the lower surfaces form hooks or shoulders, facilitating upward movement but preventing easy removal even by pulling downward.

In this "lower position", as shown in FIG. 7 (A), lead portions 33 are inserted into respective guide apertures 52 of the lead portion locating and guiding member 5 with the tips of the end portions 34 protruding a short distance from the lower surface of the lead portion locating and guiding member 5. As a result, when the lead portion locating and guiding member 5 is in the lower position, the lead portion 33 of the contact 3 is unlikely to be hardly bent at all by external forces. Furthermore, in this position the positioning post 53 projects downward beyond the lower end of the lead 34 affording some additional protection.

When the lead portion locating and guiding member 55 is pressed further upward from the lower position, the second projections 56 ride over the stop projections 14, permitting the lead portion locating and guiding member 5 to move up to the "upper position" position shown in FIG. 6 (B) and FIG. 7 (B) with the lead portions extending further through into the guiding aperture 52 with correspondingly greater extension of the end portions therefrom, below the positioning projection 53.

As the connector is handled and transported with the lead portion locating and guiding member 5 located in the lower position, as stated above, the parts of the lead portions located above the lead portion locating and guiding member 5, between the medial portions 33*a* and the end portions 33*b* of the leads 33, are not prone to significant deformation even when they are subjected to an external force, since they are supported at both ends and since the lead portion locating and guiding member 5 is very stable, not liable to tilt or twist.

The connector is applied to the printed board with the lead portion locating and guiding member 5 located in the lower position so that the positioning projections 53 on the lower surface of the lead portion locating and guiding member 5 can be inserted into the positioning holes of the circuit board. This aligns respective guiding aperture 52 of the lead portion locating and guiding member with the through-holes of the circuit board and inserts tips of the end portions 34 of the leads only a short distance into respective through-holes.

The contact members 3 are then pressed downward together with the housing 1 moving relative to the lead portion locating and guiding member 5 on the printed board forcing the lead portion locating and guiding member 5 to adopt the upper position, as shown in FIG. 6 (B) and FIG. 7 (B). As a result, the leads portions 33 are fully inserted into the through-holes of the circuit board and soldering thereof completes the installation.

Precisely vertical movement between the housing 1, the contact members 3 and the lead locating and guiding member is assured by the precise interfit between the guide projections 54 and the guide grooves 13, so that the lead portions 33 of the contact members 3 are pressed straight into the guiding aperture 52, without bending. Therefore, the insertion operation of the contact members 3 can be performed in a simple and reliable manner.

Figure 10:
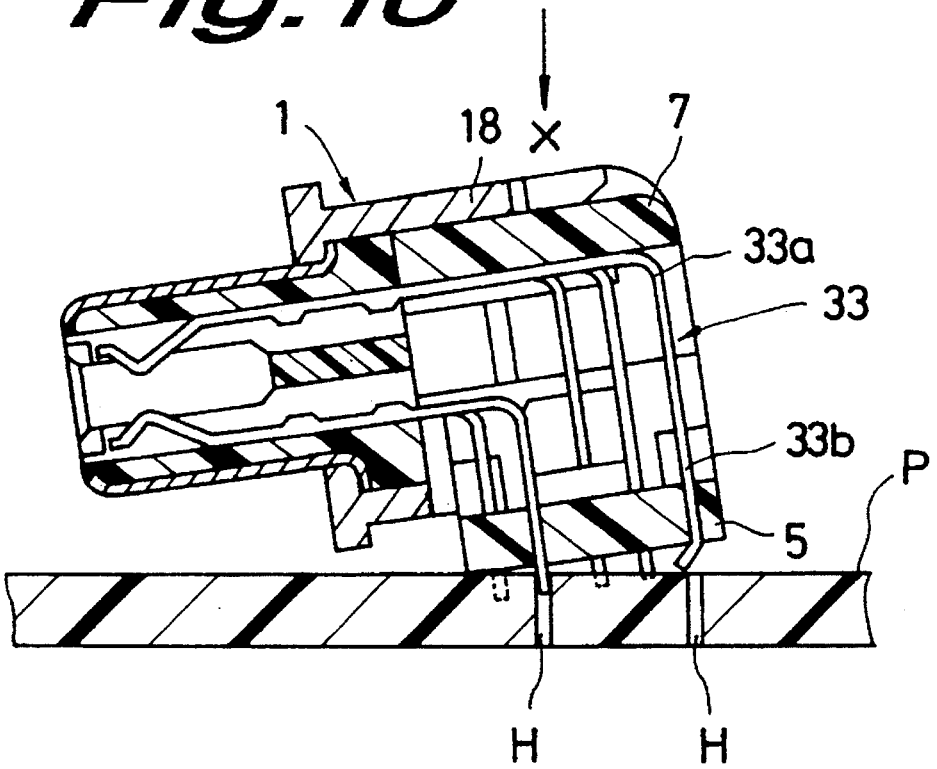

However, as shown in FIG. 10, if during transportation, the tips of the lead potions which portions which project below the lead portion locating and guiding member 5 are subjected to a locally deforming external force, the deformed portion sometimes touches the upper surface of the board P without being inserted into the through-holes H. If the housing 1 is pressed onto the circuit board, the deformed leads 33 are subjected to an upward reaction force from the board P but upward movement thereof is stopped by the lead portion retaining member 7. Conversely, the housing 1 cannot be pressed down properly to adopt a horizontal position as a result of such resistance. As a result of the improper position of the housing, it is easy to detect that some leads 33 cannot be inserted into the through-holes H.

When such deformed leads 33 are discovered they can be straightened, or the contact members 3 replaced. In this case, the lead portion retaining member 7 is released, as can be seen from FIG. 8, by pressing the latching heads 71*a* back out from the hook receiving apertures 16*b*, so that it can be easily removed from the main housing body 10.

In the example described above, the lead portion retaining member 7 does not engage the contact members 3 which are held on the lower side of the main housing body 10 and such engagement is not normally considered necessary as the lead portions are short and of high rigidity with little risk of upward movement and deformation. However, if required it is entirely feasable for the 1 prt to contact the upper surfaces of the medial portions 33*a* of these short leads, in the same manner.

The invention both minimizes risk of lead portions being deformed both prior to and during mounting of the connector on a circuit board and enables any such deformed lead portions to be detected easily during the circuit board mounting step, facilitating repair and obviating quality control difficulties otherwise arising from an undetected faulty connector installation.

We claim:

1. An electrical connector of a right angle header type comprising a housing having a front, mating face, a rear face and a lower, board engaging face extending between the front face and the rear face, at least a part of the housing being insulating, a series of contact members mounted in the insulating part of the housing with connecting portions at the mating face and lead portions extending from the rear face, the lead portions being bent transversely intermediate their ends thereby forming medial portions extending rearward from the rear face and board connecting portions extending downward so that free ends of the board connecting portions are insertable into respective connecting through-holes of a circuit board by movement of the board engaging face of the housing into engagement with the circuit board; a lead locating and guiding member having a series of lead receiving apertures at positions corresponding to the connecting holes of the circuit board for receiving respective connecting portions and means on the housing and on the lead locating and guiding member cooperable for mounting the lead locating and guiding member on the housing for sliding movement from a first, lead locating position, receiving respective connecting portions at locations adjacent respective free ends thereof, to a second position, remote from the free ends, during movement of the board connecting portions progressively into respective connecting through-holes of the circuit board; and, a lead portion retaining member, means on the housing and the lead portion retaining member cooperable to releasably attach the lead portion retaining member to the housing to extend over upper sides of the medial portions remote from their free ends thereby to prevent upward movement of respective medial portions away from the circuit board during insertion of the end portions into the respective connecting through-holes, the lead portion retaining member being formed with a series of lead portion locating grooves which extend rearward from the rear face for snugly receiving medial portions of respective lead portions.

2. An electrical connector according to claim 1 further comprising a lead locating and guiding member having a series of lead receiving apertures at positions corresponding to the connecting holes of the circuit board for receiving respective connecting portions and means on the housing and on the lead locating and guiding member cooperable for mounting the lead locating and guiding member on the housing for sliding movement from a first, lead locating position, receiving respective connecting portions at locations adjacent respective free ends thereof, to a second position, remote from the free ends, during movement of the board connecting portions progressively into respective connecting through-holes of the circuit board.

3. An electrical connector according to claim 2 wherein the housing comprises a pair of wall portions extending rearward in spaced apart, parallel relation from a front wall and the cooperable mounting means comprises vertical guide grooves on respective opposed surfaces of the wall portions for slidingly receiving guide projections provided on respective opposite ends of the lead locating and guiding member.

4. An electrical connector according to claim 3 wherein the cooperable mounting means comprises vertically spaced, stop projections provided on one of the lead locating and guiding member and the housing for engagement above and below a stop projection provided on one of the housing and lead locating and guiding member, respectively, thereby to retain the lead locating and guiding member in the first, lead locating position.

5. An electrical connector according to claim 1 wherein the lead portion retaining member comprises a plate-form body and the means on the housing and the lead portion retaining member cooperable to attach the lead portion retaining member to the housing comprises upper and lower guide rail means formed on the housing to extend rearward from the rear face thereof for retaining the body of the lead portion retaining member therebetween, extending over the medial portions.

6. An electrical connector according to claim 1 wherein the means on the housing and the lead portion retaining member cooperable to attach the lead portion retaining member to the housing comprises resilient latching arms with latching heads formed at respective opposite ends of the body of the lead portion retaining member and latching apertures formed on the housing for receiving respective latching arms with a snap action thereby to retain the body of the lead portion retaining member between the guide rail means.

7. An electrical connector of a right angle header type comprising a housing having a front, mating face, a rear face and a lower, board engaging face extending between the front face and the rear face, at least a part of the housing being insulating, a series of contact members mounted in the insulating part of the housing with connecting portions at the mating face and lead portions extending from the rear face, the lead portions being bent transversely intermediate their ends thereby forming medial portions extending rearward from the rear face and board connecting portions extending downward so that free ends of the board connecting portions are insertable into respective connecting through-holes of a circuit board by movement of the board engaging face of the housing into engagement with the circuit board;

a lead locating and guiding member having a series of lead receiving apertures at positions corresponding to the connecting holes of the circuit board for receiving respective connecting portions and means on the housing and on the lead locating and guiding member cooperable for mounting the lead locating and guiding member on the housing for sliding movement from a first, lead locating position, receiving respective connecting portions at locations adjacent respective free ends thereof, to a second position, remote from the free ends, during movement of the board connecting portions progressively into respective connecting through-holes of the circuit board, and a lead portion retaining member, means on the housing and the lead portion retaining member cooperable to attach the lead portion retaining member to the housing to extend over upper sides of the medial portions remote from their free ends thereby to prevent upward movement of respective medial portions away from the circuit board during insertion of the end portions into the respective connecting through-holes wherein the housing comprises a pair of wall portions extending rearward in spaced apart, parallel relation from a front wall and the cooperable mounting means comprises vertical guide grooves on respective opposed surfaces of the wall portions for slidingly receiving guide projections provided on respective opposite ends of the lead locating and guiding member.

8. An electrical connector according to claim 7 wherein the means on the housing and the lead portion retaining member cooperable to attach the lead portion retaining member to the housing releasably attaches the lead portion retaining member to the housing.

9. An electrical connector according to claim 2 wherein the lead portion retaining member comprises a plate-form body and the means on the housing and the lead portion retaining member cooperable to attach the lead portion retaining member to the housing comprises upper and lower guide rail means formed on the housing to extend rearward from the rear face thereof for retaining the body of the lead portion retaining member therebetween, extending over the medial portions.

10. An electrical connector according to claim 16 wherein the means on the housing and the lead portion retaining member cooperable to attach the lead portion retaining member to the housing comprises resilient latching arms with latching heads formed at respective opposite ends of the body of the lead portion retaining member and latching apertures formed on the housing for receiving respective latching arms with a snap action thereby to retain the body of the lead portion retaining member between the guide rail means.

11. An electrical connector according to claim 15 wherein the cooperable mounting means comprises vertically spaced, stop projections provided on one of the lead locating and guiding member and the housing for engagement above and below a stop projection provided on one of the housing and lead locating and guiding member, respectively, thereby to retain the lead locating and guiding member in the first, lead locating position.

12. An electrical connector according to claim 7 wherein the lead portion retaining member is formed with a series of lead portion locating grooves which extend rearward from the rear face for snugly receiving medial portions of respective lead portions.

13. An electrical connector of a right angle header type comprising a housing having a front, mating face, a rear face and a lower, board engaging face extending between the front face and the rear face, at least a part of the housing being insulating, a series of contact members mounted in the insulating part of the housing with connecting portions at the mating face and lead portions extending from the rear face, the lead portions being bent transversely intermediate their ends thereby forming medial portions extending rearward from the rear face and board connecting portions extending downward so that free ends of the board connecting portions are insertable into respective connecting through-holes of a circuit board by movement of the board engaging face of the housing into engagement with the circuit board; and a lead portion retaining member, means on the housing and the lead portion retaining member cooperable to releasably attach the lead portion retaining member to the housing to extend over upper sides of the medial portions remote from their free ends thereby to prevent upward movement of respective medial portions away from the circuit board during insertion of the end portions into the respective connecting through-holes wherein the lead portion retaining member comprises a plate-form body and the attachment means comprises upper and lower guide rail means formed on the housing to extend rearward from the rear face thereof for retaining the body of the lead portion retaining member therebetween, extending over the medial portions.

14. An electrical connector according to claim 13 further comprising a lead locating and guiding member having a series of lead receiving apertures at positions corresponding to the connecting holes of the circuit board for receiving respective connecting portions and means on the housing and on the lead locating and guiding member cooperable for mounting the lead locating and guiding member on the housing for sliding movement from a first, lead locating position, receiving respective connecting portions at locations adjacent respective free ends thereof, to a second position, remote from the free ends, during movement of the board connecting portions progressively into respective connecting through-holes of the circuit board.

15. An electrical connector according to claim 14 wherein the housing comprises a pair of wall portions extending rearward in spaced apart, parallel relation from a front wall and the cooperable mounting means comprises vertical guide grooves on respective opposed surfaces of the wall portions for slidingly receiving guide projections provided on respective opposite ends of the lead locating and guiding member.

16. An electrical connector according to claim 15 wherein the cooperable mounting means comprises vertically spaced, stop projections provided on one of the lead locating and guiding member and the housing for engagement above and below a stop projection provided on one of the housing and lead locating and guiding member, respectively, thereby to retain the lead locating and guiding member in the first, lead locating position.

17. An electrical connector according to claim 13 wherein the means on the housing and the lead portion retaining member cooperable to attach the lead portion retaining member to the housing comprises resilient latching arms with latching heads formed at respective opposite ends of the body of the lead portion retaining member and latching apertures formed on the housing for receiving respective latching arms with a snap action thereby to retain the body of the lead portion retaining member between the guide rail means.

18. An electrical connector according to claim 13 wherein the lead portion retaining member is formed with a series of lead portion locating grooves which extend rearward from the rear face for snugly receiving medial portions of respective lead portions.

19. An electrical connector of a right angle header type comprising a housing having a front, mating face, a rear face and a lower, board engaging face extending between the front face and the rear face, at least a part of the housing being insulating, a series of contact members mounted in the insulating part of the housing with connecting portions at the mating face and lead portions extending from the rear face, the lead portions being bent transversely intermediate their ends thereby forming medial portions extending rearward from the rear face and board connecting portions extending downward so that free ends of the board connecting portions are insertable into respective connecting through-holes of a circuit board by movement of the board engaging face of the housing into engagement with the circuit board; and, a lead portion retaining member, means on the housing and the lead portion retaining member cooperable to releasably attach the lead portion retaining member to the housing for releasable engagement with upper sides of the medial portions remote from their free ends thereby to prevent upward movement of respective medial portions away from the circuit board during insertion of the end portions into the respective connecting through-holes.

20. An electrical connector of a right angle header type comprising a housing having a front, mating face, a rear face and a lower, board engaging face extending between the front face and the rear face, at least a part of the housing being insulating, a series of contact members mounted in the insulating part of the housing with connecting portions at the mating face and lead portions extending from the rear face in spaced apart relation so that they are exposed for upward movement relative to one another, the lead portions being bent transversely intermediate their ends thereby forming medial portions extending rearward from the rear face and board connecting portions extending downward so that free ends of the board connecting portions are insertable into respective connecting through-holes of a circuit board by movement of the board engaging face of the housing into engagement with the circuit board; and a lead portion retaining member, means on the housing and the lead portion retaining member cooperable to attach the lead portion retaining member to the housing to extend over upper sides of the medial portions remote from their free ends thereby to prevent the upward movement of respective medial portions away from the circuit board during insertion of the end portions into the respective connecting through-holes.

21. An electrical connector according to claim 20 wherein the means on the housing and the lead portion retaining member cooperable to attach the lead portion retaining member to the housing are integral formed with the housing and lead portion retaining member, respectively.

* * * * *